US006736113B1

(12) United States Patent
Ott

(10) Patent No.: US 6,736,113 B1
(45) Date of Patent: May 18, 2004

(54) IGNITION SYSTEM AND IGNITION CONTROL METHOD

(75) Inventor: Karl Ott, Markgroningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,491

(22) PCT Filed: Oct. 14, 1999

(86) PCT No.: PCT/DE99/03301

§ 371 (c)(1),
(2), (4) Date: Oct. 1, 2001

(87) PCT Pub. No.: WO00/39456

PCT Pub. Date: Jul. 6, 2000

(30) Foreign Application Priority Data

Dec. 28, 1998 (DE) ..... 198 60 452

(51) Int. Cl.[7] ..... F02D 7/00

(52) U.S. Cl. ..... 123/481; 123/630; 123/198 F; 701/101; 73/117.3

(58) Field of Search ..... 123/90.15, 406.24, 123/435, 436, 479–481, 630, 688, 406.12, 406.13, 406.14, 198 F; 701/101, 110, 111; 73/116, 117.3

(56) References Cited

U.S. PATENT DOCUMENTS 4,635,590 A * 1/1987 Gerace ..... 123/27 R
5,105,657 A * 4/1992 Nakaniwa ..... 73/117.3
5,334,938 A 8/1994 Kugler et al. ..... 324/399
5,343,844 A 9/1994 Fukui et al. ..... 123/481
5,359,882 A 11/1994 Fukui ..... 73/117.3
5,991,685 A * 11/1999 Fukuchi et al. ..... 701/110
6,023,651 A * 2/2000 Nakayama et al. ..... 701/110
6,338,326 B1 * 1/2002 Ebeling et al. ..... 123/198 F

FOREIGN PATENT DOCUMENTS

EP 0 306 905 3/1989
JP 10 054295 2/1998

OTHER PUBLICATIONS

Patent Abstracts of Japan, vol. 1998, No. 06 (Apr. 30, 1998).

* cited by examiner

*Primary Examiner*—Willis R. Wolfe
*Assistant Examiner*—Johnny H. Hoang
(74) *Attorney, Agent, or Firm*—Kenyon & Kenyon

(57) ABSTRACT

An ignition system for an internal combustion engine, which has at least two cylinders, having a detection device for detecting the misfirings occurring at each cylinder, and having a calculation device which, for each cylinder, has at least one associated misfiring counter that, in response to a misfiring detected in the cylinder in one revolution of the internal combustion engine, is increased as a function of the total number of misfirings in all cylinders detected in the preceding revolution.

9 Claims, 1 Drawing Sheet

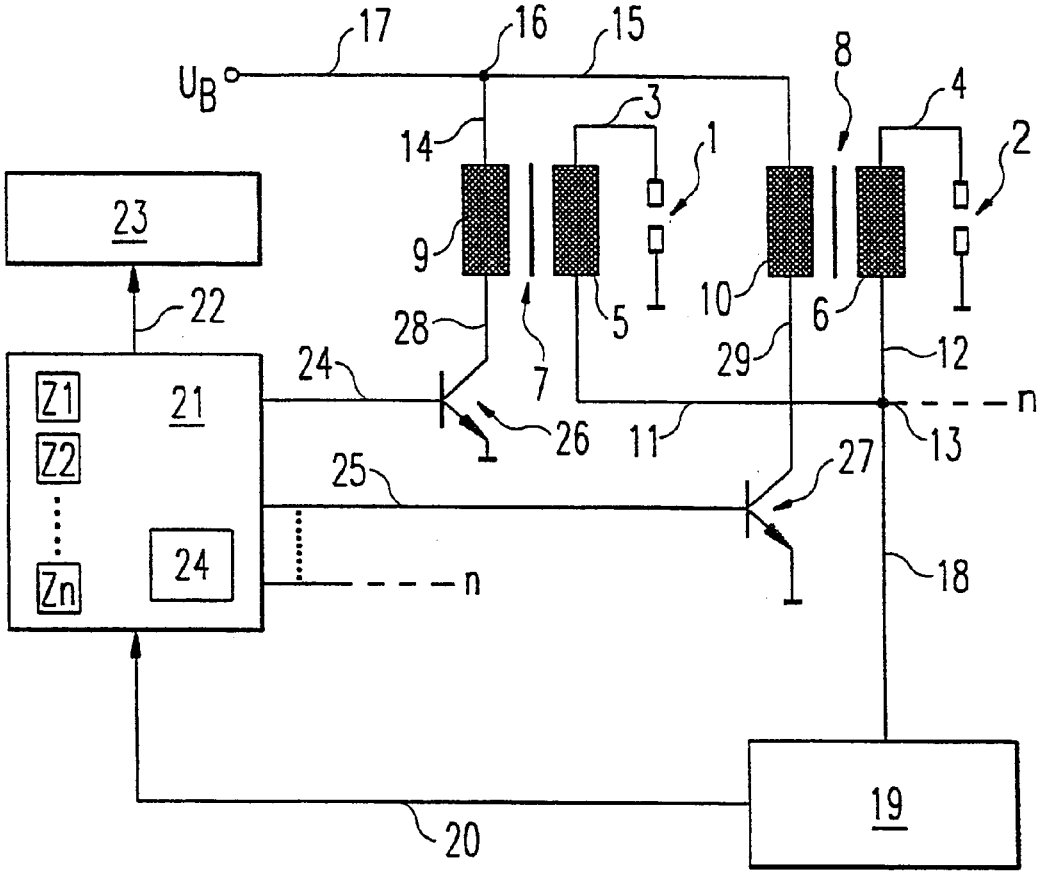
17
16
15
8
$U_B$
4
3
14
1
2
23
9
10
22
28
5
6
7
29
12
24
21
26
11
13
n
Z1
Z2
25
27
24
Zn
n
18
19
20

IGNITION SYSTEM AND IGNITION CONTROL METHOD

FIELD OF THE INVENTION

The present invention relates to an ignition device and a method for controlling emergency measures for a combustion engine which has a plurality of cylinders, a separate misfiring counter being provided for each cylinder.

BACKGROUND INFORMATION

Ignition systems for internal combustion engines having a plurality of combustion cylinders, may have, for each cylinder, a corresponding misfiring counter in a control unit. The combustion cylinders of the internal combustion engine are ignited by ignition coils, which have a primary winding and a secondary winding, through inductive generation of a high voltage. The currents appearing in the secondary circuit may be detected by an ignition-current sensor and supplied to an ignition evaluation unit in a cylinder-selective manner. If the ignition-current sensor detects a misfiring in one of the monitored cylinders, it may emit a corresponding misfire counting signal to the evaluation unit. The evaluation unit may increase an internal misfiring counter, provided for the cylinder, by a predetermined increment value which is an adjustable, constant counter rise such as 2. If no misfiring is detected for the appertaining cylinder, the corresponding misfiring counter may be decremented by an adjustable, constant decrement value, e.g. by 1.

In the practical application of the ignition-current evaluation, it is believed that the dimensioning of the detection circuit may have A great influence. If the detection circuit is designed so that it reacts early to a misfiring, the danger may exist that ignitions in the cylinder which occurred in the desired manner are mistakenly recognized as misfirings, as well. Conversely, in a design of the detection circuit in which weaker current signals in the secondary circuit of the ignition system still generates a trigger signal in the detection circuit as well, then actually occurring misfirings produced, for example, by a carbon-fouled spark plug, may be not recognized. A certain number of occurring mal-triggerings, which occur when ignitions that are really successful are recognized as faulty, may be filtered out by first resorting to measures when the misfiring counter of the cylinder in question has reached a predefined, adjustable counter threshold value.

However, the counter threshold value may not be too high, and the counter rise, with which the counter is increased when a misfiring is detected, may not be too low, in order that a sufficiently rapid reaction in response to a plurality of misfirings occurring in succession is ensured, particularly for the protection of the catalytic converter. Since the misfiring counter in such ignition systems may have a constant counter rise, when establishing the counter threshold value, it is believed that a compromise should be found between a rapid reaction for protecting the catalytic converter when several cylinders fail simultaneously, and a statistical filtering-out in the evaluation of possibly mistakenly detected, individual misfirings at the cylinder. The counter threshold value should thus be high enough on the one hand, in order not to be exceeded by erroneous individual misfirings, and on the other hand, must be low enough to ensure a quick reaction.

It is believed that such ignition systems may have the disadvantage that they do not take into account how many misfirings have occurred in the various cylinders of the internal combustion engine, for example, in a cylinder bank. If misfirings occur simultaneously in several cylinders during one revolution, the ignition system must react particularly rapidly. In these ignition systems, the individual misfiring counters of the cylinders may be increased independently of the misfiring behavior of other cylinders. In the event of the simultaneous occurrence of misfirings in several cylinders, it is believed that this can lead to the ignition system reacting too slowly.

SUMMARY OF THE INVENTION

It is believed that the exemplary ignition device and the exemplary method for controlling emergency measures in an internal combustion engine according to the present invention, have the advantage that, when evaluating the misfiring behavior of one cylinder, the misfirings detected at the remaining cylinders are also taken into account, and a quick reaction of the ignition system is at least better ensured in the event that misfirings occur simultaneously at various cylinders.

An exemplary embodiment of the ignition device according to the present invention has a detection device for detecting the misfirings occurring at each cylinder, and a calculation device which has at least one misfiring counter for each individual cylinder, the cylinder counter, in response to a misfiring detected in the associated cylinder during one engine revolution, being increased as a function of the total number of misfirings of all cylinders detected in the preceding engine revolution.

The present exemplary embodiment and/or exemplary method of the present invention involve the fact that the misfiring counter of one cylinder may be no longer increased with a constant increment value in response to a detected misfiring as in known methods heretofore, but rather with a variable increment value which is so much the higher, the more cylinders exhibit a misfiring during the preceding engine revolution.

According to a further exemplary embodiment of the ignition device and/or exemplary method according to the present invention, when an adjustable counter threshold value is exceeded by a misfiring counter for this cylinder, the calculation device may emit an emergency-measure control signal to an emergency-measure control device for initiating an emergency measure.

According to an aspect of an exemplary embodiment of the ignition device and/or exemplary method according to the present invention, the emergency measure may be the injection of the corresponding cylinder being switched off (or interrupted).

According to a further aspect of an exemplary embodiment of the ignition device and/or exemplary method according to the present invention, the misfiring counter may be increased by a variable increment value which is calculated by multiplying the total number of misfirings in all cylinders detected in the preceding revolution, with a constant, adjustable initial increment factor.

In another exemplary embodiment of the ignition device and/or exemplary method according to the present invention, the calculation device may decrement the misfiring counter of a cylinder when the detection device detects no misfiring for this cylinder.

According to yet another exemplary embodiment of the ignition device and/or exemplary method according to the present invention, the misfiring counter may be decremented by a constant, adjustable value when no misfiring is detected by the detection device for this cylinder.

According to yet another exemplary embodiment of the ignition device according to the present invention, for each cylinder, a plurality of different misfiring counters for different emergency measures may be provided which, in each case, have separately adjustable initial increment factors and counter threshold values.

It is believed that this may provide the special advantage that various measures can be carried out at various threshold values in dependence on the values of the various misfiring counters.

BRIEF DESCRIPTION OF THE DRAWING

The FIGURE shows an exemplary embodiment of an ignition system according to the present invention for internal combustion engines which have a plurality of combustion cylinders (only an ignition system for two combustion cylinders is shown in the FIGURE, however, the number of combustion cylinders can be increased as needed.)

DETAILED DESCRIPTION

The combustion cylinders (not shown) are ignited in each case by spark plugs 1, 2. Spark plugs 1, 2 are connected via lines 3, 4 to secondary windings 5, 6 which belong to ignition coils 7, 8. Each ignition coil 7, 8 has a primary winding 9, 10 which is inductively coupled to associated secondary winding 5, 6. Secondary windings 5, 6 are connected via lines 11, 12 to a node 13. Primary windings 9, 10 of ignition coils 7, 8 are connected via lines 14, 15 to a node 16. A battery voltage $U_B$ is applied to node 16 via a line 17. Node 13 in the secondary circuit of the ignition system is connected to a detection device 19 via a current-sensing line 18. Detection device 19 is connected via at least one detection signal line or misfiring counting-signal line 20 to a calculation device 21 that has at least one detection signal line or misfiring counter Z1, Z2, . . . , Zn for each cylinder of the internal combustion engine. Calculation device 21 is connected via at least one emergency-measure control line 22 to an emergency-measure control device 23. Calculation device 21, via control lines 24, 25, controls switching stages 26, 27 which are connected to primary windings 9, 10 of ignition coils 7, 8 via lines 28, 29. Switching stages 26, 27 are, for example, transistors.

In the case of an ignition carried out in one combustion cylinder, an ignition current flows across appertaining spark plug 1, 2, the ignition current may be detected via ignition-current sensing line 18 by detection device 19 with the aid of an ignition-current sensor. If a misfiring occurs, a sufficiently high ignition current does not flow at the appertaining spark plug, so that detection device 19 can recognize, in a cylinder-selective manner, whether a misfiring exists at a specific cylinder. If the detection device recognizes that a misfiring has occurred, it emits a misfiring-recognition signal via line 20 to calculation device 21. Calculation device 21 may increase the internal misfiring counter belonging to the corresponding cylinder by a variable increment value when it receives a misfiring-detection signal for the corresponding cylinder via line 20. In this context, the increment value may be not constant, but may be rather a function of the total number of misfirings detected for all cylinders in the preceding revolution of the internal combustion engine. To that end, calculation device 21 may have an internal storage device 24 in which the number of misfirings detected during the last engine revolution are stored.

In an exemplary embodiment of the ignition system according to the present invention, the variable increment value is calculated by multiplying the stored total number of misfirings in the preceding engine revolution, with a constant, adjustable initial increment factor. If, for example, in a basic setting, the initial increment factor is 2 per recognized misfiring, and if three misfirings at three different cylinders are detected by detection device 19 during a first engine revolution, then the increment value is increased to 6. If a misfiring is detected once more at one of the cylinders in the next engine revolution, then its internal misfiring counter is incremented with this increased increment value.

The quantity of misfirings per engine revolution is co-evaluated with this type of evaluation. In this manner, it may be also taken into account, for example, that several misfirings per revolution are more harmful than misfirings which are distributed over various revolutions. If, for example, a complete cylinder bank, e.g. six cylinders, of an engine fails, given an initial increment factor of 2, the variable increment value increases markedly to 12, for instance, so that the pre-programmed counter threshold value is already reached after detection of a few consecutive misfirings, in order to initiate an appropriate emergency measure by emergency-measure control device 23. In this manner, the reaction rate of the ignition system in response to a simultaneous occurrence of a plurality of misfirings at different cylinders may be perceptibly increased, so that a measure can be initiated particularly quickly for protecting the catalytic converter. If an internal misfiring counter $Z_i$ of calculation device 21 reaches the pre-programmed counter threshold value, calculation device 21 emits an emergency-measure control signal via the emergency-measure control line to emergency-measure control device 23 which initiates an appropriate emergency measure. This emergency measure may be, for example, that the injection for the cylinder in question is switched off.

In a further exemplary embodiment of the ignition system according to the present invention, a plurality of internal misfiring counters for different emergency measures are provided for each cylinder. In particular, the respective initial increment factors and the counter threshold values for each of the various misfiring counters can be set separately. It is believed that it is thereby possible to implement various measures as a function of the misfirings determined in the preceding revolution.

In another exemplary embodiment of the ignition system according to the present invention, the misfirings for a plurality of preceding revolutions are stored in internal storage device 24 of calculation device 21, so that they can be evaluated by calculation device 21. It is believed that it is thereby possible to detect misfirings occurring periodically at the cylinders and to initiate appropriate measures.

It is believed that with a storage device 24, that is dimensioned to be suitably large, calculation device 21 can statistically evaluate the misfiring behavior of a cylinder over a longer period of time and take measures accordingly. For example, the calculation device can emit a warning signal when the statistical evaluation of the misfirings at one cylinder reveal an increasing wear and tear of the spark plug.

What is claimed is:

1. An ignition device for an internal combustion engine, which has at least two cylinders, the ignition device comprising:

a detection device for detecting a misfiring occurring at each of the at least two cylinders; and a calculation device, the calculation device including, for each of the at least two cylinders, at least one misfiring counter that, in response to a misfiring in an associated cylinder detected in a revolution of the internal combustion engine, increases as a function of a total number of misfirings in the at least two cylinders detected in a preceding revolution wherein:

an adjustable error threshold value is exceeded by one of the at least one misfiring counter for the associated cylinder, the calculation device emits an emergency-measure control signal to an emergency-measure control device for initiating an emergency measure at the associated cylinder.

2. The ignition system of claim 1, wherein an injection of the associated cylinder is be switchable off by the emergency-measure control device as a function of the emergency-measure control signal.

3. An ignition device for an internal combustion engine, which has at least two cylinders, the ignition device comprising:

a detection device for detecting a misfiring occurring at each of the at least two cylinders; and a calculation device, the calculation device including, for each of the at least two cylinders, at least one misfiring counter that, in response to a misfiring in an associated cylinder detected in a revolution of the internal combustion engine, increases as a function of a total number of misfirings in the at least two cylinders detected in a preceding revolution, wherein:

in response to the misfiring detected in the revolution of the internal combustion engine, the at least one misfiring counter increases by a variable increment value that is calculated by multiplying a constant, adjustable initial increment factor and the total number of misfirings detected in the preceding revolution.

4. An ignition device for an internal combustion engine, which has at least two cylinders, the ignition device comprising:

a detection device for detecting a misfiring occurring at each of the at least two cylinders; and a calculation device, the calculation device including, for each of the at least two cylinders, at least one misfiring counter that, in response to a misfiring in an associated cylinder detected in a revolution of the internal combustion engine, increases as a function of a total number of misfirings in the at least two cylinders detected in a preceding revolution, wherein:

the calculation device decrements the at least one misfiring counter of the associated cylinder when no misfiring is detected for the associated cylinder during the revolution.

5. The ignition system of claim 4, wherein the at least one misfiring counter is decremented by a constant, adjustable amount.

6. An ignition device for an internal combustion engine, which has at least two cylinders, the ignition device comprising:

a detection device for detecting a misfiring occurring at each of the at least two cylinders; and a calculation device, the calculation device including, for each of the at least two cylinders, at least one misfiring counter that, in response to a misfiring in an associated cylinder detected in a revolution of the internal combustion engine, increases as a function of a total number of misfirings in the at least two cylinders detected in a preceding revolution, wherein:

for each of the at least two cylinders, the at least one misfiring counter includes a plurality of misfiring counters for different emergency measures; and initial increment factors and counter threshold values used in the ignition system are adjustable separately.

7. A method for controlling emergency measures in an internal combustion engine having a plurality of cylinders, the method comprising the steps of:

detecting a misfiring for each of the plurality of cylinders occurring during a first revolution;

calculating a variable increment value as a function of a total number of misfirings detected for the plurality of cylinders during the first revolution;

increasing a misfiring counter associated with a corresponding cylinder of the plurality of cylinders by the variable increment value when a misfiring is detected in the corresponding cylinder in a second revolution following the first revolution; and emitting an emergency-measure control signal for initiating an emergency measure at the corresponding cylinder when the misfiring counter associated with the corresponding cylinder exceeds a specific, adjustable counter threshold value.

8. The method of claim 7, wherein the variable increment value is calculated by multiplying a constant, adjustable initial increment factor and the total number of misfirings detected for the plurality of cylinders during the first revolution.

9. The method of claim 7, wherein the misfiring counter associated with the corresponding cylinder is decremented when no misfiring is detected for the corresponding cylinder.

* * * * *